US005172970A

United States Patent [19]

Momose et al.

[11] Patent Number: 5,172,970

[45] Date of Patent: Dec. 22, 1992

[54] ELECTRIC LOCKER APPARATUS WITH EMERGENCY UNLOCKING

[75] Inventors: Yoshinori Momose; Hideto Watabe; Masahisa Kujiraoka; Keizo Watanabe; Masanori Takagi; Hiroshi Sato, all of Tokyo, Japan

[73] Assignee: Cleanup Corporation, Tokyo, Japan

[21] Appl. No.: 679,307

[22] Filed: Apr. 2, 1991

[30] Foreign Application Priority Data

Jul. 12, 1990 [JP] Japan ..... 2-73373[U]

[51] Int. Cl.[5] ..... A47B 88/00

[52] U.S. Cl. ..... 312/329; 292/201; 70/84

[58] Field of Search ..... 312/219, 220, 107.5; 292/201, 18; 70/279, 84

[56] References Cited

U.S. PATENT DOCUMENTS

| | | | |
|---|---|---|---|
| 3,831,408 | 8/1974 | Featherman | 70/84 |
| 3,936,108 | 2/1976 | Chitester | 312/219 X |
| 4,894,717 | 1/1990 | Komei . | |
| 4,979,384 | 12/1990 | Malesko et al. | 292/201 X |

FOREIGN PATENT DOCUMENTS

| | | |
|---|---|---|
| 62-281100 | 12/1987 | Japan . |
| 64-57372 | 4/1989 | Japan . |
| 64-57373 | 4/1989 | Japan . |

*Primary Examiner*—Joseph Falk

*Attorney, Agent, or Firm*—Dvorak and Traub

[57] ABSTRACT

An electric locker apparatus with a plurality of locker boxes each having an electric lock device including a latch member normally maintained by a stopper member in a lock position in engagement with the door of the box, and biased toward an unlock position wherein the door can be opened, and an actuator responsive to electric command signal, with an output member movable into an operative position for allowing the latch member to be released from the stopper member and moved into the unlock position. The apparatus further includes an emergency unlocking device for forcibly moving the output member of the actuator into the operative position without requiring input of the command signal. The unlocking device has an emergent key cylinder into which an emergent key can be inserted from outside. The angular motion of the key is converted into a linear motion of the output member of the actuator toward the operative position.

5 Claims, 3 Drawing Sheets

ELECTRIC LOCKER APPARATUS WITH EMERGENCY UNLOCKING

BACKGROUND OF THE INVENTION

1. Field of the Invention

The present invention relates generally to an electric locker apparatus including an electric lock device operative to normally control opening and/or closure of the door of a locker box; more particularly, it pertains to such an electric locker apparatus which is further provided with an emergency unlocking device for forcibly opening the door in case of an emergent situation.

2. Description of the Prior Art

Various kinds of locker apparatus with a plurality of locker boxes are usually installed in public spaces, e.g. railway station, airport and entrance hall of condominium, etc, often in the form of coin lockers. Because the locker boxes are then accessible and can be used by a number of indefinite people, it is sometimes necessary for an administrator to open the door of a particular locker box by using a master key or master card and to take out the article in that box for various reasons. This is particularly the case when the article has been left beyond a prescribed period, without being timely cleared away by the user, or when the article is one whose storage in the locker box is prohibited.

In the case of an electric locker apparatus incorporating a microprocessor wherein opening of the door of a locker box is controlled by an electric lock device, it is a common practice for an administrator to unlock the lock device and open a particular locker box, by opening the door of a control box in which relevant controller and keyboard are installed, and subsequently inputting necessary data in accordance with instruction as prescribed in a manual. Thus, when it is necessary to immediately open the locker box in emergent occasions such as electric power stoppage or troubles in the lock device itself, the absence of an administrator who is skilled in the relatively complicated operation may be detrimental in that an emergent unlocking cannot be achieved within a minimized time. Moreover, depending upon software or hardware of the system, an emergent unlocking may result in opening of all the locker boxes even when it is necessary to open a particular locker box only, whereby privacy of users of other locker boxes may not be adequately protected.

SUMMARY OF THE INVENTION

Therefore, it is a primary object of the present invention to provide an improved electric locker apparatus which makes it possible to carry out an emergent unlocking in a facilitated manner, even in the absence of a skilled administrator.

To this end, the present invention provides an improved electric locker apparatus which comprises a base frame member, a locker box mounted on the base frame member and having a door and an interior space accessible from outside with the door opened, and an electric lock device arranged in the interior space of the locker box near the door. The lock device includes a latch member normally maintained by a stopper member in a lock position in engagement with the door, and movable into and normally biased toward an unlock position for allowing the door to be disengaged from the latch member and thereby opened. The lock device further includes an acutator which is responsive to an electric command signal, having an output member movable into a predetermined operative position for allowing the latch member to be released from the stopper member and moved into the unlock position.

The locker apparatus according to the present invention is featured by an emergency unlocking device for forcibly moving the output member of the actuator into the operative position without requiring the electric command signal. The unlocking device includes an emergent key cylinder into which a predetermined emergent key can be inserted from outside, and a mechanical motion conversion means for converting an angular motion of the emergent key into a linear motion of the output member of the actuator toward its operative position.

With the abovementioned arrangement of the apparatus according to the present invention, while the electric lock device is normally operative to control opening of the door of a locker box, an emergent unlocking for forcibly opening the door can be carried out mechanically, i.e. without complicated step of command data input, simply by using an emergent key. Thus, even in the absence of a skilled administrator, the emergent unlocking can be readily completed within a minimized time.

DETAILED DESCRIPTION OF THE PREFERRED EMBODIMENT

The present invention will now be described in further detail hereinafter, with reference to a specific embodiment illustrated in the accompanying drawings.

Figure 1:
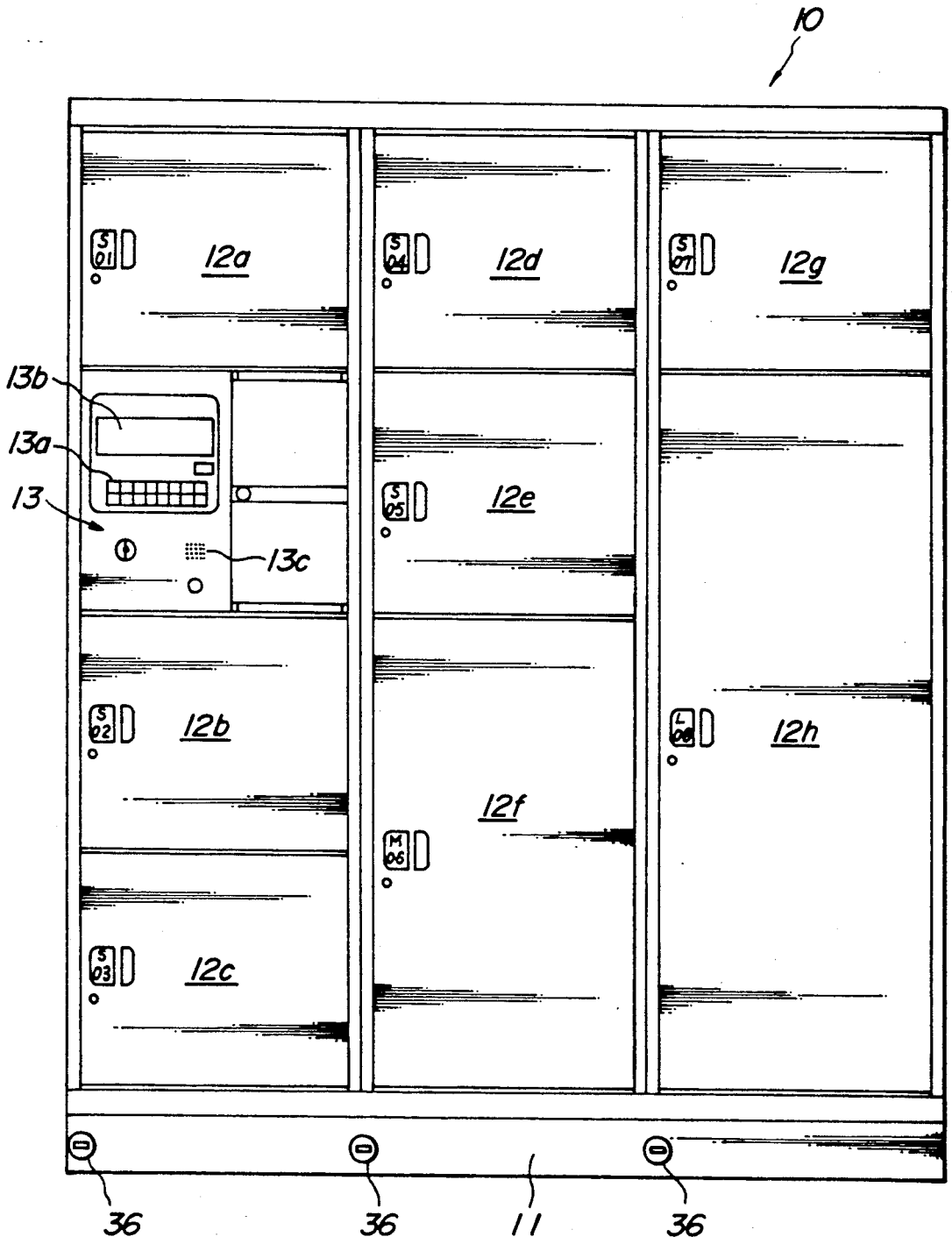
FIG. 1 is a front view showing an electric locker apparatus according to one embodiment of the present invention.

There is shown in FIG. 1 an electric locker apparatus according to the present invention, which is designated as a whole by reference numeral 10. The locker apparatus 10 includes a base frame member 11, and a plurality of locker boxes 12*a* to 12*h* and a console 13 accommodating an electric control unit are arranged on the frame member 11.

More particularly, in the illustrated embodiment, three small-sized boxes 12*a* to 12*c* and the console 13 are vertically aligned with each other to form a first row. Similarly, two small-sized boxes 12*d*, 12*e* and one medium-sized box 12*f* are vertically aligned with each other to form a second row. Finally, one small-sized box 12*g* and one large-sized box 12*h* are vertically aligned with each other to form a third row. In this connection, the medium sized box 12*f* and the large-sized box 12*h* may have volumes or capacities which are respectively twice and three times the volume or capacity of a small-sized box. For identification purpose, the locker boxes 12*a* to 12*h* are applied, on the front surfaces of their doors 14, with designation labels SO1 to SO5, MO6, SO7 and LO8, respectively.

The electric control unit, which is accommodated in the console 13 as mentioned above, may include a CPU in the form of a microprocessor (not shown), a keyboard 13*a* for normally allowing a user to input necessary data to open a particular locker box, a LCD or the like visual display 13*b*, an electro-acoustic transducer 13*c* which may be used as loudspeaker and/or microphone, etc. The arrangement of the control unit itself is not the subject of the present invention, so that a further detailed description will not be required. In this connection, relevant technology is more fully disclosed, for example, in U.S. Pat. No. 4,894,717 issued Jan. 16, 1990 to Komei, and Japanese Patent Application Laid-open Publication No. 62-281,100, an unexamied publication dated Dec. 5, 1987, whose disclosures are thus incorporated herein by reference.

Figure 2:
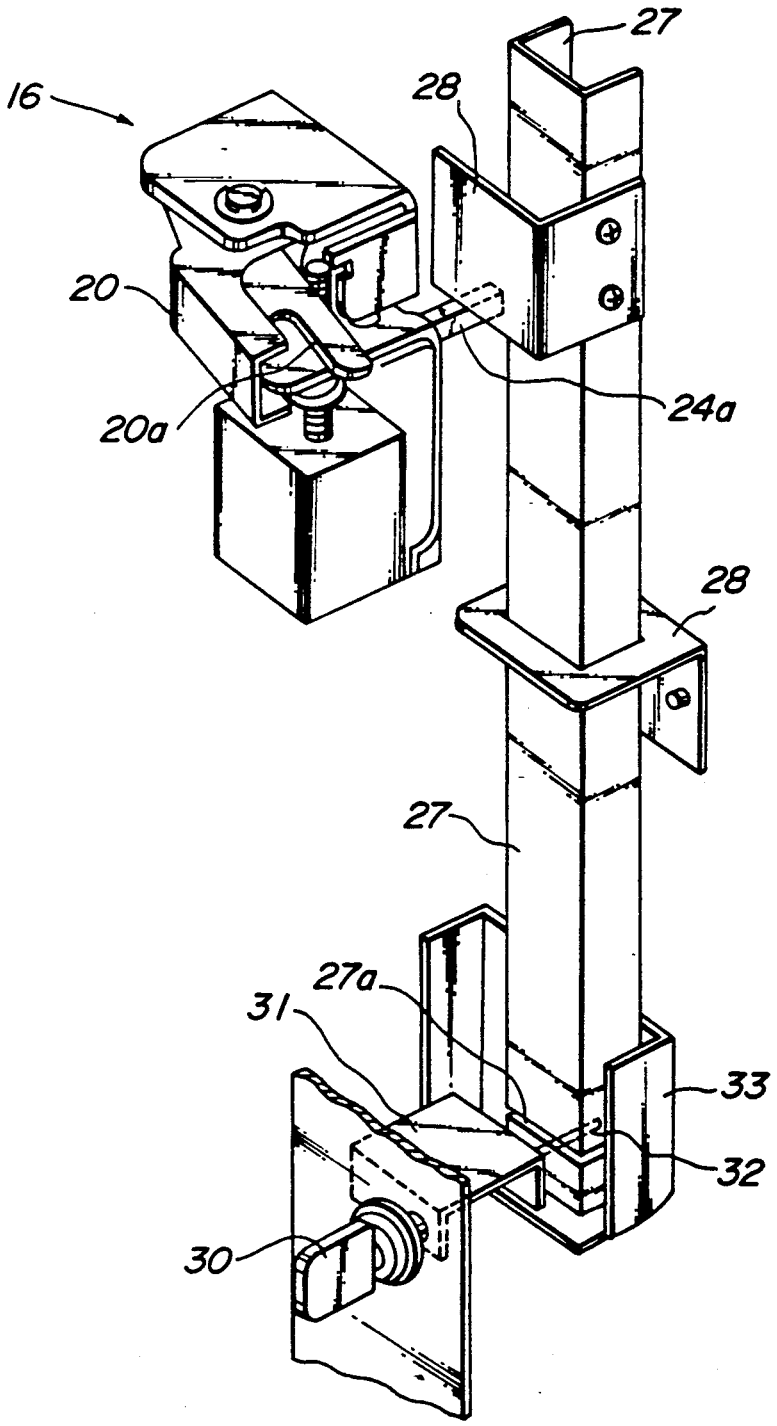
FIG. 2 is a perspective view showing the emergency unlocking device in combination with an electric lock device in the locker apparatus shown in FIG. 1.
Figure 3:
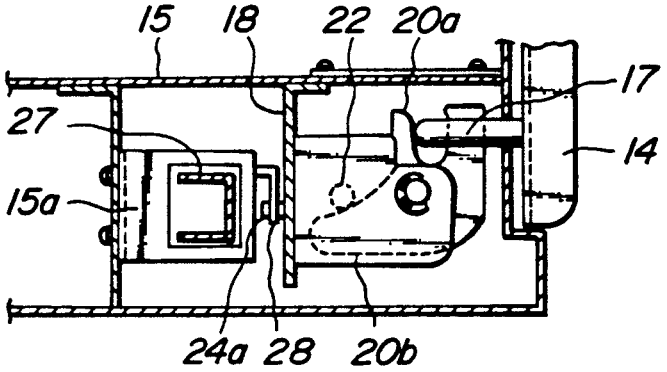
FIGS. 3 and 4 are cross-sectional view and longitudinal-sectional view of the unlocking device, respectively.
Figure 4:
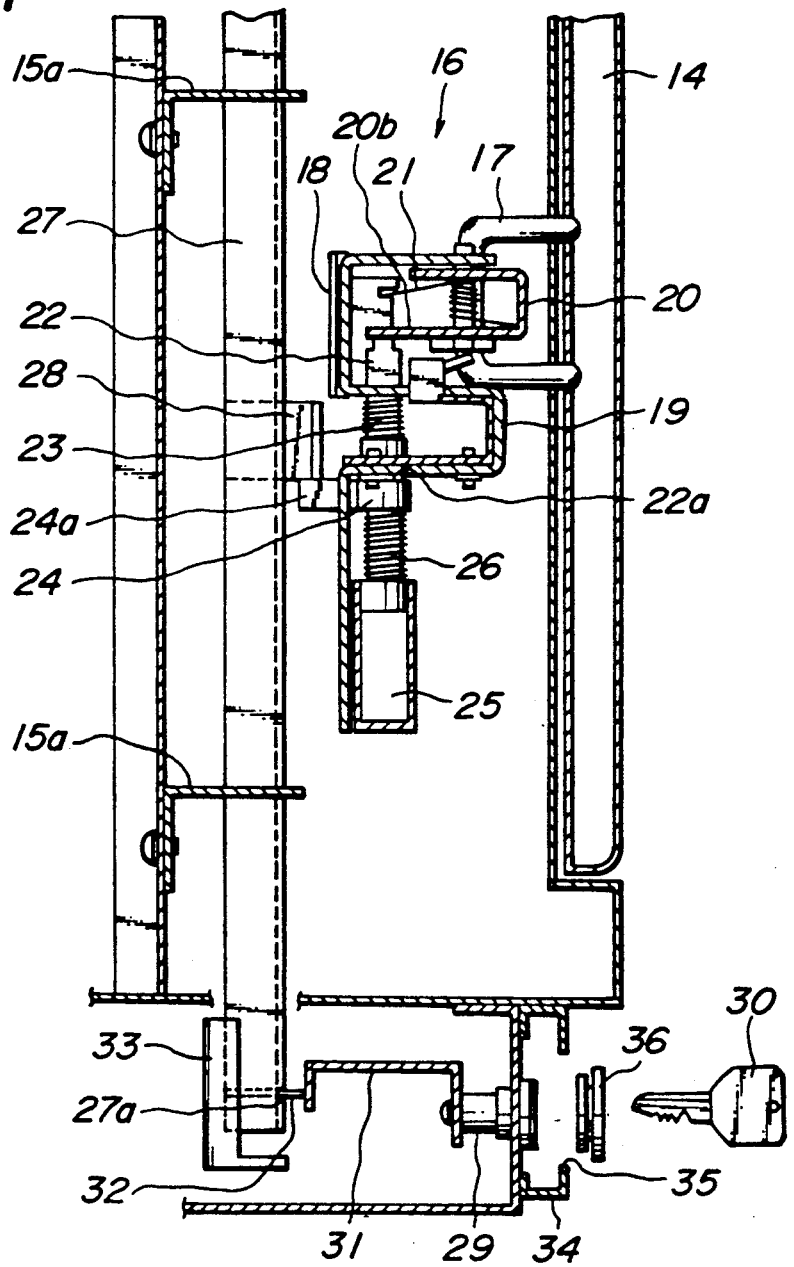

Referring now to FIGS. 2 to 4, the locker apparatus 10 further includes a vertical frame member 15 for each row of the locker boxes 12*a*, 12*b*, 12*c*; 12*d*, 12*e*, 12*f*; 12*g*, 12*h*. Each frame member 15 is secured to the base frame member 11, and arranged to extend along the relevant locker boxes 12*a* to 12*h* on one side of the front opening of each box. The locker boxes 12*a* to 12*h* are each provided with an electric lock device 16 to be described hereinafter, which is arranged in the relevant frame member 15. On the other hand, as shown in FIGS. 3 and 4, an arm bar 17 of a substantially U-shaped configuration is rigidly secured to the rear surface of the door of the locker box 12*a* to 12*h* at its two leg sections so as to project rearwards, i.e. toward the lock device 16. The arm bar 17 is engageable with the lock device 16 to maintain the door 14 of the locker box in a locked state, and disengageable therefrom to open the door 14.

The electric lock device 16 is secured to the locker box by means of a substantially L-shaped fixture 18 (FIG. 3), and includes a bracket 19 for rotatably supporting a latch member 20 which is formed on one side with a recess 20*a* for engagement with the arm bar 17. The latch member 20 is normally biased by a torsional coil spring 21 toward its unlock position, i.e. toward the door 14 of the locker box, wherein the arm bar 17 can be disengaged from the recess 20*a* to open the door 14. The latch member 20 is however normally maintained in a lock position wherein the arm bar 17 is kept in engagement with the recess 20*a*. To this end, the latch member 20 is provided with a tongue 20*b* on its side opposite to the recess 20*a*, which is engageable with a movable stopper member 22. As will be described hereinafter, the stopper member 22 is movable in a vertical direction.

The arrangement is such that when the door 14 of the locker box is closed, with the arm bar 17 in engagement with the recess 20*a* of the latch member 20, the latch member 20 is rotated toward its lock position against the biasing force of the spring 21, whereby the tongue 20*b* is moved beyond the stopper member 22 assuming a downward position. The stopper member 22 is subsequently moved unwards and comes into abutment with the edge of the tongue 20*b*. Then, the rotation of the latch member 20 toward its unlock positon, under the influence of the spring 21, is prohibited so that the arm bar 17 is kept in engagement with the latch member 20 which is maintained in its lock position.

When, on the other hand, the stopper member 22 is moved downwards and disengaged from the latch member 20, the biasing force of the spring 21 causes the latch member 20 to rotate toward its unlock position where the arm bar 17 can be disengaged from the recess 20*a* to open the door 14.

The stopper member 22 is in the form of a rod which is normally biased by a spring 23 downwards, and has a lower end 23*a* whose lower surface is engageable with an output member or plunger 24 of a solenoid 25 constituting an electric actuator. The plunger 24 is attracted downwards by energizing the solenoid 25, accompanying a downward movement of the stopper member 22 under the biasing force of the spring 23 and thereby allowing the door 14 to be opened. The plunger 24 itself is biased upwards by a spring 26 though the upward movement of the stopper member 22 when the solenoid 25 is deenergized is limited at a position wherein the stopper member 22 is in abutment with the edge of the tongue 20*b*. To ths end, the stopper member 22 extends through an opening in the bracket 19 and the lower 22*a* is formed as a collar whose upper surface is engageable with the bracket 19.

The abovementioned arrangement of the electric lock device 16 is similar to those disclosed in Japanese Utility Model Application Laid-open Publication Nos. 64-57,372 and 64-57,373, both unexamined publications dated Apr. 10, 1989, whose disclosures are incorporated herein by reference.

The locker apparatus 10 according to the present invention further includes an emergency unlocking device for forcibly moving the plunger 24 of the solenoid 25 in a mechanical manner, i.e. without requiring the electric command signal. The arrangement of the unlocking device is explained below.

The plunger 24 of each solenoid 25 is provided with an extension 24*a* which projects at substantially right angle to its longitudinal direction. A vertical rod 27 is arranged within the vertical frame member 15 adjacent to the lock device 16 of each rocker box 12*a* to 12*h*, and guided for vertical movement by means of guide elements 15*a* secured to the vertical frame member 15. The rod 27 is provided with unlocking projections 28 corresponding in number to locker boxes 12*a* to 12*h* in the vertical row. Each projection 28 is thus engageable with the extension 24*a* of the corresponding solenoid 25.

The base frame member 11 is provided with emergent key cylinders 29 corresponding in number to the vertical rows of the rocker boxes 12*a* to 12*h*, each being adapted to be inserted by a predetermined emergent key 30. When the abovementioned electric control unit accommodated in the console 13 is operated by using a master key, this key may constitute the emergent key 30 to be inserted into the key cylinder 29. In this case, it is possible to facilitate maintainance of the key.

To each key cylinder 29, there is secured an unlocking tongue 31 which serves to support an operating pin 32 on its free end. The pin 32 is eccentric to the center axis of the key cylinder 29, and is received by a sliding groove 27*a* which is formed in the lower end of the rod 27 transversely to its longitudinal direction. The rotation or angular motion of the emergent key 30 is transmitted through the cylinder 29 and the unlocking tongue 31 to the eccentric operating pin 32 which cooperates with the slliding groove 27*a* to convert the angular motion into a linear motion.

The angular motion of the emergent key 30 thus causes the vertical rod 27 to move vertically downwards, thereby bringing the projection 28 of the rod 27 into engagement with the extension 24*a* of the corresponding solenoid 25, and forcibly lowering the plunger 24. Because the rod 27 with a plurality of projections 28 is engageable with the plungers 24 of all the solenoids 25 of the locker boxes 12*a* to 12*h* forming a vertical row, operation of the emergent key 30 results in opening of all the boxes in a row.

It is of course that the projections 28 of the rod 27 are to be normally maintained disengaged from the respective plungers 24 of the solenoids 25 for the locker boxes 12*a* to 12*h* forming a row, so that the unlocking device does not affect the normal operation of the locking device 16. A stopper 33 may be arranged below the vertical rod 27 to prevent an excessive downward movement of the rod 27, thereby avoiding damages to the solenoids 25.

When the emergent key 30 is rotated in opposite direction and returned into its initial position, the rod 27 is lifted to its original position so that the projections 28 are disengaged from the plungers 24 of the solenoids 25. Thus, the solenoids 25 are not influenced by the emergent key 30 so that the locking device 16 resumes the normal function.

There is further provided a protective vertical wall 34 on the base frame member 11, which is formed with openings 35 in front of the key cylinders 29. The openings 36 are normally covered by cap members 36 of plastic material, which can be removed by using an appropriate tool or coin, whenever it is required to get an access to the key cylinder 29.

It will be readily appreciated from the foregoing detailed description that the present invention provides an improved electric locker apparatus with an emergent unlocking device for forcibly opening of the locker box mechanically, without complicated step of command data input, simply by using an emergent key. Thus, even in the absence of a skilled administrator, the emergent unlocking can be readily completed within a minimized time.

The present invention is not limited to the illustrated embodiment which has been explained by way of example, and various modifications and/or alterations may be made without departing from the scope of the invention. For example, while the unlocking of the locker boxes 12*a* to 12*h* are carried out in the abovementioned embodiment by lowering the vertical rod 27, this is not a prerequisite condition. Thus, the unlocking of the locker boxes 12*a* to 12*h* may be carried out by lifting the vertical rod 27. Furthermore, the plunger 24 and the stopper member 22 illustrated as being separate components may be combined into an integral element. Moreover, the angular motion of the of the emergent key 30 may be converted into a linear motion of the vertical rod 27 for example by using other conversion mechanism, including a lever or a wire.

What is claimed is:

1. An electric locker apparatus comprising:

A) a base frame member;

B) a plurality of rows of locker boxes mounted on the base frame member, each row including at least two locker boxes which are vertically aligned with each other, and each locker box having a door and an interior space which is accessible from outside when the door is opened;

C) electric lock devices associated with respective locker boxes, each lock device being arranged in the interior space of the relevant locker box near the door and including (i) a latch member normally maintained by a stopper member in a lock position in engagement with the door, and movable into and normally biased toward an unlock position for allowing the door to be disengaged from the latch member and thereby opened, and (ii) an actuator operative in response to an electric command signal and having an output member which is movable into a predetermined operative position for allowing the latch member to be released from the stopper member and moved into said unlock position;

D) an electric control unit for normally controlling the operation of the lock device of a selected locker box by providing said command signal to the actuator of the relevant locker box, said control unit including (i) a console box which is vertically aligned with the locker boxes of selected ones of said rows, (ii) a keyboard arranged on a front panel of the console box so that a user can operate the control unit for actuating the lock device of a locker box, and (iii) at least one component which is accommodated inside of said console box and accessible from outside by using a predetermined master key; and E) a plurality of emergency unlocking devices arranged in said base frame member and associated with said rows of the locker boxes, respectively, for forcibly opening the doors of the relevant locker boxes without requiring said command signal, said unlocking devices each including (i) an emergent key cylinder into which said master key can be inserted from outside, and (ii) a mechanical motion conversion means for converting an angular motion of said master key into a linear motion of the output members of the actuators of the relevant locker boxes toward the respective operative positions.

2. The locker apparatus as set forth in claim 1, wherein said emergency unlocking device further includes a rod which is connected to said mechanical motion conversion means and linearly movable in its longitudinal direction so as to be selectively engaged with and disengaged from the output members of the relevant actuators.

3. The locker apparatus as set forth in claim 1, wherein said emergency unlocking device further includes a rod which is connected to said mechanical motion conversion means and linearly movable in its longitudinal direction so as to be selectively engaged with and disengaged from the relevant stopper members.

4. The locker apparatus as set forth in claim 1, wherein said base frame member has a protective wall formed with openings in front of the respective emergent key cylinders for said rows of the locker boxes, each opening being normally closed by a cap member which can be readily removed from the protective wall without a specific tool.

5. The locker apparatus as set forth in claim 4, wherein said cap member can be removed from the protective wall by using a coin.

* * * * *